US006637968B2

(12) United States Patent
Ko

(10) Patent No.: US 6,637,968 B2
(45) Date of Patent: Oct. 28, 2003

(54) THREE-RING BINDER WITH ACTUATING CRANK

(75) Inventor: Chung Nin Ko, Kowloon (HK)

(73) Assignee: Hong Kong Stationery Manufacturing Co., Ltd., Kowloon (HK)

( * ) Notice: Subject to any disclaimer, the term of this patent is extended or adjusted under 35 U.S.C. 154(b) by 0 days.

(21) Appl. No.: 09/849,596

(22) Filed: May 7, 2001

(65) Prior Publication Data

US 2002/0164194 A1 Nov. 7, 2002

(51) Int. Cl.[7] ..... B42F 3/04

(52) U.S. Cl. ..... 402/41; 24/67.9; 402/35; 402/70; 402/75

(58) Field of Search ..... 402/31, 35, 37, 402/38, 41, 42, 500, 40, 39, 70, 75; 24/67.3, 67.9

(56) References Cited

U.S. PATENT DOCUMENTS

| | | | | |
|---|---|---|---|---|
| 778,910 A | | 1/1905 | Soennecken | |
| 1,929,614 A | * | 10/1933 | Tannehill et al. | 402/35 |
| 2,158,056 A | * | 5/1939 | Cruzan | 402/38 |
| 2,494,898 A | | 1/1950 | Rea | |
| 2,789,561 A | | 4/1957 | Bonn et al. | |
| 2,894,513 A | | 7/1959 | Gempe et al. | |
| 3,083,713 A | * | 4/1963 | Meurer | 402/35 |
| 3,950,107 A | * | 4/1976 | Seaborn | 24/16 PB |
| 4,172,675 A | * | 10/1979 | Lacourt | 402/27 |
| 5,076,722 A | * | 12/1991 | Rohner | 402/34 |
| 5,511,825 A | * | 4/1996 | Van De Pol | 281/36 |
| 6,155,737 A | * | 12/2000 | Whaley | 281/27.1 |
| 2003/0044221 A1 | * | 3/2003 | To et al. | 402/41 |

FOREIGN PATENT DOCUMENTS

EP 962336 A1 * 12/1999 ..... B42F/13/24

OTHER PUBLICATIONS

Blumberg Excelsior, 2001 Catalog, Blumberg Lever Arch Binders, p. 32.

* cited by examiner

*Primary Examiner*—A. L. Wellington
*Assistant Examiner*—Mark Henderson
(74) *Attorney, Agent, or Firm*—Shoemaker and Mattare

(57) ABSTRACT

A three-ring binder has an actuator crank which closes the rings against the bias of a leaf spring. The crank is turned by means of a lever having a roller thereon that engages a throw of the crank. The roller is arranged on the lever so that it goes past center and locks the rings closed when the lever is fully depressed. Each of the throws of the crank may have its own actuating roller, in which case all the rollers are linked together so as to move in unison.

4 Claims, 3 Drawing Sheets

THREE-RING BINDER WITH ACTUATING CRANK

BACKGROUND OF THE INVENTION

This invention relates to a three-ring binder having an actuating crank.

Many modem ring binder mechanisms have actuating levers for opening and closing two, three or more rings. In some such devices, the levers also lock the rings closed. The typical arrangement is to attach the bottoms of the ring halves to hinged plates confined between the edges of an arcuate metal housing which provides a toggling action as the plates snap between open and closed positions.

Other devices have been proposed in which the rings are opened and/or closed by a cam-type mechanism. Prior such constructions are seen in U.S. Pat. Nos. 778,910, 2,494,898, 2,789,561, and 2,894,513. U.S. Pat. No. 778,910 discloses a two-ring binder which is opened by lifting the end of a lever which depresses a crank whose ends are the movable ends of the two rings. It would be advantageous to have a three-ring mechanism of the crank-actuated type.

SUMMARY OF THE INVENTION

An object of the invention is to improve the operation of a crank-operated ring binder having three or more rings.

These and other objects are attained by a three-ring binder having a support plate, and at least three rings, each comprising a movable segment pivotally attached to the support plate and an immovable segment affixed to said support plate, and a mechanism for moving the rings between an open position and a closed and locked position. The mechanism includes a crank pivotally supported on the support plate for oscillation about a longitudinal axis. The crank has plural throws offset from the longitudinal axis. The movable ring segments are integrally attached to said crank. A leaf spring biases the crank toward a rings-closed position, and a manually operable lever moves the crank toward a rings-open position. The lever is pivotally mounted on said support plate and depresses the throw, moving the crank towards its rings-closed position, as the lever is depressed.

BRIEF DESCRIPTION OF THE DRAWINGS

In the accompanying drawings.

DESCRIPTION OF THE PREFERRED EMBODIMENT

Figure 1:
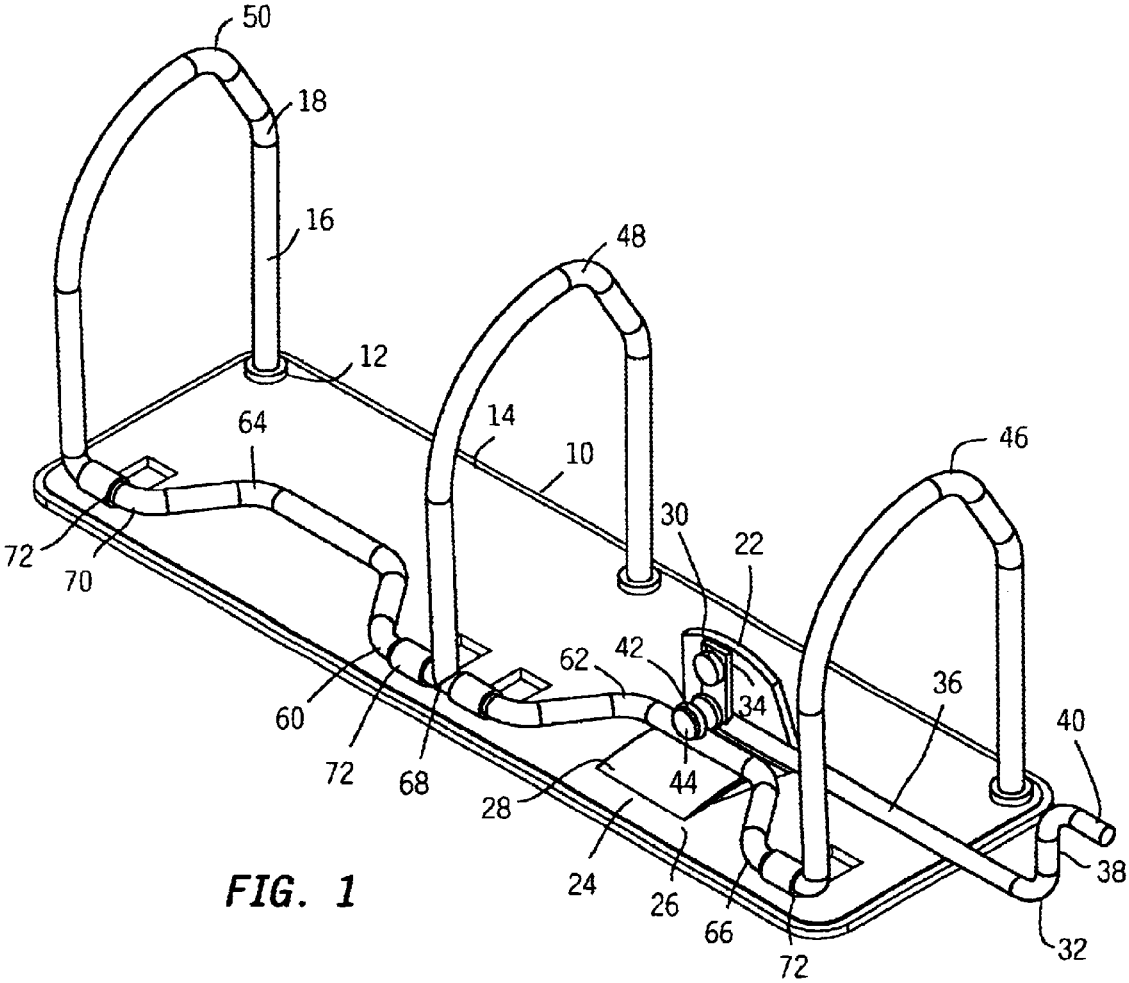
FIG. 1 is an isometric view of a three-ring binder embodying the invention, showing the binder is its closed configuration.

The invention is embodied in a three-ring binder comprising a support plate 10 having raised portions or plateaus formed by embossing. Projections 12 on the plateau 14 support the bottoms 16 of stationary ring members, which extend perpendicularly, and whose upper ends 18 are bent inward about 30° from vertical.

A large tab 22 is bent perpendicularly out from the support plate. A narrow slot 24 is cut across the top of the area from which the tab was deformed, leaving a bridge 26 which is deformed slightly upward and bears against the bottom surface of a leaf spring 28 whose fixed end is held within the slot. The leaf spring's free end provides an upward bias against a crank described below.

A pin 30 is staked or welded to the top of the tab, facing the spring side. One end of an actuating lever 32 is pivotally mounted on the pin, whose head is flattened to retain the lever.

The lever has a first end segment 34, an intermediate segment 36 perpendicular to the first end, and a second end segment 38 perpendicular the intermediate segment. A flattened tip 40 extends from the end of the second end, parallel to the intermediate segment. The lever 32 pivots in the center plane of the device. It has a circumferentially grooved nylon roller 42 fixed on a headed pin 44 which is fixed to and extends from the lever near the intersection of the first end segment and the intermediate segment. The distance between the pins 30 and 44 is about half an inch.

Three movable ring segments 46, 48, 50 are supported on a common crank 60. Each movable ring segment is J-shaped, having a straight segment connected to the crank and a curved segment having a radius of about two inches, and forming about a 150° arc. The end of the curved segment has a conical depression which receives a corresponding point on the fixed segment. The outer segments 46, 50 are actually extensions of the crank, while the center ring segment 48 is attached to the crank at its middle, by welding or other means.

The crank 60 has two throws 62,64, each in the form of a straight segment offset from the crank journals 66,68,70 by about ⅝ inch. The crank pivots around tabs 72 which are bent up out of the support plate and are curled around the journals to form bearings. The leaf spring 28 bears up against the bottom of the throw, tending to move the crank in a direction which opens the ring segments.

The nylon roller 42 engages the crank throw 62 from above. As the lever is depressed, the roller rolls along the crank throw, pushing the throw towards the support plate, thus closing the ring segments. When the lever strikes the support plate, the roller is slightly past center, and locks the throw down. The upward spring bias holds the lever in this position until the lever is manually lifted.

Figure 2:
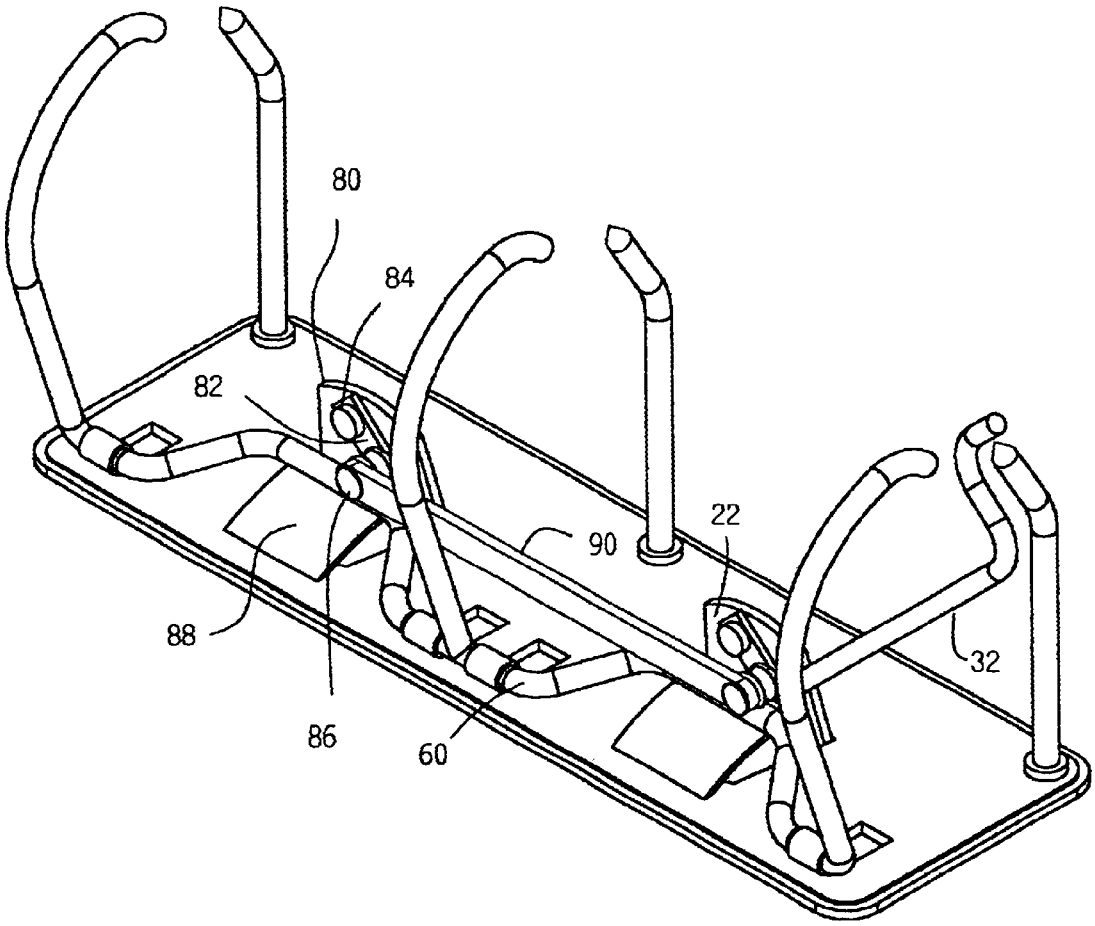
FIG. 2 is a similar view of an alternative form of the invention, showing the binder in its open configuration.
Figure 3:
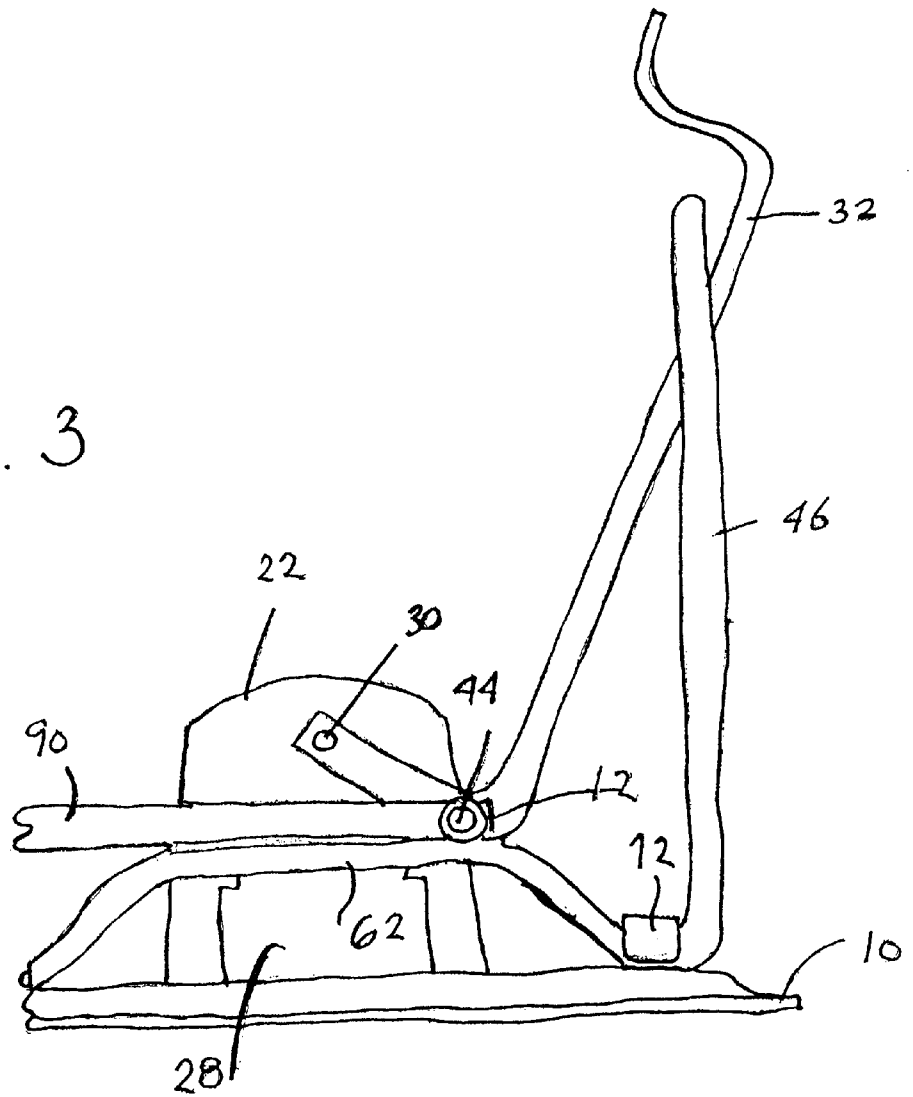
FIG. 3 is a enlarged detail of a portion of FIG. 2.

In one version of the invention (FIG. 1), the support plate has only one tab, and only one roller actuates the crank. In an alternative version (FIG. 2), there are two tabs, and the second tab 80 supports an idler arm 82, which has a size, orientation and function similar to the first end segment of the lever. The idler arm pivots on a pin 84 attached to the second tab, and has a pin 86 affixed to it upon which the second roller turns. A second spring 88 bears upward against the second crank throw at this point. The two roller pins are interconnected by a link 90 through whose ends the pins 44,86 pass. The link causes the levers to move in unison so that when one depresses the lever, the rollers move identically, each pushing down on its respective crank. This construction, by minimizing crank twist, closes the ring segments more positively.

While the device described is a three-ring binder, it should be understood that the invention is equally applicable to binders having more than three rings. For example, a five-ring binder could have up to four crank throws and corresponding rollers and idler arms.

Since the invention is subject to modifications and variations, it is intended that the foregoing description and the accompanying drawings shall be interpreted as only illustrative of the invention defined by the following claims.

I claim:

1. A ring binder mechanism comprising a support plate, at least three rings, each comprising a movable segment pivotally attached to said support plate and an immovable segment affixed to said support plate, a mechanism for moving said rings between an open position and a closed and locked position, said mechanism comprising a crank pivotally supported on said support plate for oscillation about a longitudinal axis, said crank having plural throws offset from said longitudinal axis, said movable ring segments being integrally attached to said crank, a spring biasing said crank toward a rings-closed position, a manually operable lever for moving said crank toward a rings-open position, said lever being pivotally mounted on said support plate for oscillating movement, said lever having means for engaging a first of said throw so as to move the crank towards its rings-closed position as the lever is depressed toward said support plate, an idler arm pivotally supported on said plate adjacent a second of said throws, said idler arm having a pin affixed thereto and a roller retained on said pin, said roller being positioned so as to roll along said second throw, and a link connecting the idler arm to the lever, causing the lever and the idler arm move in unison, whereby force manually applied to the lever is distributed to both said crank throws.

2. The invention of claim 1, wherein the spring is a leaf spring having a fixed end supported by the support plate and a free end engaging one of said crank throws.

3. The invention of claim 2, wherein said means for engaging said first throw is a roller mounted on a pin affixed to said lever, said roller being positioned so as to roll along said first throw as said lever is depressed.

4. The invention of claim 3, wherein the lever is constructed so that the roller passes center in its movement with respect to said crank throw, producing a toggle action which locks the lever down against the support plate when the lever is fully depressed against the support plate.

* * * * *